United States Patent [19]

Carlson

[11] 4,121,999

[45] Oct. 24, 1978

[54] CATALYTIC OXIDATION OF PETROLEUM DISTILLATES WITH CHARCOAL AND WITH SUPPORTED METAL PHTHALOCYANINE

[75] Inventor: David H. J. Carlson, Park Ridge, Ill.

[73] Assignee: UOP Inc., Des Plaines, Ill.

[21] Appl. No.: 822,962

[22] Filed: Aug. 8, 1977

[51] Int. Cl.[2] ..... C10G 27/06

[52] U.S. Cl. ..... 208/206

[58] Field of Search ..... 208/206, 207, 189; 252/445, 431 N

[56] References Cited

U.S. PATENT DOCUMENTS

| | | | |
|---|---|---|---|
| 3,371,031 | 2/1968 | Strong | 208/206 |
| 4,033,860 | 7/1977 | Carlson | 208/207 |

*Primary Examiner*—George Crasanakis

*Attorney, Agent, or Firm*—James R. Hoatson, Jr.; Robert W. Welch; William H. Page, II

[57] ABSTRACT

A catalytic process for treating sour petroleum distillates is disclosed. A sour petroleum distillate containing phenolic catalyst toxins or toxin precursors are pretreated in contact with an oxidizing agent and a charcoal adsorbent at conditions to oxidize a portion of the mercaptan content of said distillate to disulfides, and to adsorb substantially all of said phenolic toxin and toxin precursors from the distillate. The distillate is thereafter treated in an alkaline environment in contact with an oxidizing agent and a supported metal phthalocyanine catalyst to oxidize the residual mercaptans contained therein to disulfides.

10 Claims, No Drawings

CATALYTIC OXIDATION OF PETROLEUM DISTILLATES WITH CHARCOAL AND WITH SUPPORTED METAL PHTHALOCYANINE

Processes for the treatment of sour petroleum distillates, wherein the distillate is treated in an alkaline environment in contact with an oxidizing agent and a supported metal phthalocyanine catalyst, have become well-known and widely practiced in the petroleum refining industry. Said processes are typically designed to effect the oxidation of the offensive mercaptans contained in the sour distillate with the formation of innocuous disulfides — a process commonly referred to as sweetening. The sweetening process is in many cases advantageously carried out in a fixed bed treating system wherein the metal phthalocyanine catalyst is dispersed on a solid adsorbent support or carrier material disposed as a fixed bed in a treating zone, the distillate being processed through the catalyst bed in contact with an oxidizing agent and an aqueous caustic solution.

A problem associated with the fixed bed treating system concerns the phenolic catalyst toxins, or toxin precursors, which occur in the sour petroleum distillate and become adsorbed on the catalyst to promote catalyst activity instability.

It is therefore an object of this invention to present a novel catalytic process for treating sour petroleum distillates containing phenolic catalyst toxins or toxin precursors, and in one of its broad aspects the present invention embodies a process which comprises treating a sour petroleum distillate in contact with an oxidizing agent and a charcoal adsorbent at conditions to oxidize a portion of the mercaptan content of said distillate to disulfides, and to adsorb substantially all of the phenolic toxins and toxin precursors from said distillate; recovering and treating the distillate in an alkaline environment in contact with an oxidizing agent and a supported metal phthalocyanine catalyst, and oxidizing the residual mercaptans contained therein to disulfides.

Another embodiment of this invention, relating to a catalytic process for treating a sour petroleum distillate, comprises treating said distillate in contact with an oxidizing agent and a lignite-derived activated charcoal at conditions to oxidize a portion of the mercaptan content of said distillates to disulfides, and adsorbing substantially all of the phenolic toxins and toxin precursors from said distillate; recovering and treating the distillate in an alkaline environment in contact with an oxidizing agent and an activated charcoal-supported cobalt phthalocyanine catalyst, and oxidizing the residual mercaptans contained therein to disulfides.

One of the more specific embodiments concerns a process for treating a sour petroleum distillate boiling in the range of from about 135° to about 300° C. In contact with air and a lignite-derived activated charcoal at a temperature of from about 10° to about 100° C. and at a pressure of from about atmospheric to about 100 atmospheres, oxidizing a portion of the mercaptan content of said distillate, and adsorbing substantially all of the phenolic toxins and toxin precursors from said distillate; recovering and treating the distillate in an alkaline environment in contact with air and an activated charcoal-supported cobalt phthalocyanine monosulfonate catalyst and oxidizing the residual mercaptans contained therein to disulfides at a temperature of from about 10° to about 250° C. and at a pressure of from about atmospheric to about 100 atmospheres.

Other objects and embodiments of this invention will become apparent in the following detailed specification.

Pursuant to the present process, a sour petroleum distillate containing phenolic catalyst toxins and/or toxin precursors is initially treated in contact with an oxidizing agent and a charcoal adsorbent whereby a portion of the mercaptan content is converted to disulfides, and the distillate is recovered substantially free of phenolic catalyst toxins and toxin precursors. Charcoal adsorbents for use herein include any of the various charcoals produced by the destruction-distillation of wood, peat, lignite, nut shells, bones and other carbonaeous matter, and preferably such charcoals as are heat and/or chemically treated to form a highly porous particle structure of increased adsorbent capacity, and generally defined as activated carbons or charcoals. Preferred activated charcoals include vegetable-derived, bituminous coal-derived, peat-derived, petroleum black-derived, and especially lignite-derived charcoal. In particular, a lignite-derived charcoal with a surface area in excess of about 500 $m^2$/gm, and an apparent bulk density of about 0.45 gms/cc, an average pore volume of about 0.5 cc/gm, and an average pore diameter of about 35 Angstroms, has given good results. A suitable lignite-derived charcoal is commercially available under the trade name Darco MRX. Other suitable commercially available charcoals include Nuchar, which is a charcoal derived from vegetable sources such as ground wood pulp and available from Westbaco Company; Hydrodarco charcoal, which is derived from lignite and available from the Atlas Chemical Company; Norit charcoal, which is derived from peat and available from the Norit Company; Columbia charcoal, which is derived from petroleum black and available from Union Carbide Company; and Pittsburg charcoal, which is derived from bituminous coal and available from the Calgon Company. In any case, the selected charcoal adsorbent is advantageously pretreated with steam at a temperature of from about 400° to about 500° C. for a period of from about 1 to about 5 hours.

The sour petroleum distillate is suitably treated in contact with the charcoal adsorbent in admixture with air, or other oxidizing agent, at a temperature of from about 10° to about 250° C., and at a pressure of from about atmospheric to about 100 atmospheres to convert at least a portion of the mercaptan content of the distillate to disulfides, and to adsorb substantially all of the phenolic catalyst toxin and/or toxin precursors from the distillate. The phenolic toxins herein contemplated are phenolic materials, e.g., mixed phenols, catechols, resorcinols, hydroquinine, cresols, nephthols, etc., which either function as catalyst toxins or are oxidizable to catalyst toxins during the subsequent oxidation of the residual mercaptans in contact with the metal phthalocyanine catalyst. In any case, the sour petroleum distillate is preferably maintained in contact with the charcoal adsorbent for a time equivalent to a liquid hourly space velocity of from about 0.1 to about 5. Regeneration of the charcoal adsorbent can be effected periodically, as required, by conventional methods known to the art, for example, by steam regeneration at elevated temperature.

In accordance with the present process, the sour petroluem distillate, substantially free of phenolic catalyst toxins and toxin precursors, is further treated in an alkaline environment in contact with an oxidizing agent and a supported metal phthalocyanine catalyst. This oxidation reaction is effected in an alkaline environment created, for example, by charging an aqueous caustic solution in contact with the catalyst in admixture with a sour petroleum distillate, the caustic solution being charged continuously or intermittently as required to maintain the catalyst in a caustic-wetted state. Other suitable alkaline solutions particularly include aqueous potassium hydroxide solutions, but also aqueous solutions of lithium hydroxide, rubidium hydroxide and cesium hydroxide. Similarly, while water is a preferred adsolvent for the alkaline reagent, other solvents may be employed including, for example, alcohols, and especially methanol. In some cases, the treating is effected in the presence of both an aqueous solution of the alkaline reagent and an alcohol.

The sweetening process is usually effected at ambient temperature conditions although a temperature of from about 10° to about 250° C., and generally not in excess of about 150° C., may be used. The process may be effected at a pressure of from about atmospheric to about 100 atmospheres, although atmospheric or substantially atmospheric pressures are entirely suitable. Contact times equivalent to a liquid hourly space velocity of from about 1 to about 100 or more, but preferably from about 0.5 to about 5, are suitable to effect the sweetening process, an optimum contact time being dependent on the size of the treating zone, the quantity of the catalyst contained therein, and the character of the distillate being treated.

The metal phthalocyanine catalyst employed herein can be any of the various metal phthalocyanines heretofore employed in the sweetening of sour petroleum distillates, especially the Group VIII metal phthalocyanines such as cobalt phthalocyanine, iron phthalocyanine, nickel phthalocyanine, platinum phthalocyanine, palladium phthalocyanine, rhodium phthalocyanine, ruthenium phthalocyanine, osmium phthalocyanine, iridium phthalocyanine, or mixtures thereof. Other metal phthalocyanines which may be used include magnesium phthalocyanine, titanium phthalocyanine, hafnium phthalocyanine, vanadium phthalocyanine, tantalum phthalocyanine, molybdenum phthalocyanine, manganese phthalocyanine, copper phthalocyanine, silver phthalocyanine, tin phthalocyanine, and the like. The metal phthalocyanine is preferably employed as a derivative thereof, the commercially available sulfonated derivatives, for example, cobalt phthalocyanine monosulfonate, cobalt phthalocyanine disulfonate, or mixtures thereof, being particularly preferred. While the sulfonated derivatives are preferred, other derivatives, particularly the carboxylated derivatives, may be employed. The catalyst support may comprise any of the various charcoals produced by the destructive distillation of wood, peat, lignite, nutshells, bones and other carbonaceous matter, and preferably such charcoals as have been heat treated and/or chemically treated to form a highly porous particle structure of increased adsorbent capacity, and generally defined as activated carbons or charcoals. Suitable metal phthalocyanine catalyst supports further include the naturally occurring clays and silicates, for example, diatomaceous earth, fuller's earth, kieselguhr, attapulgus clay, feldspar, montmorillanite, halloysite, kaolin, and the like, and also the naturally occurring or synthetically prepared refractory inorganic oxides such as alumina, silica, zirconia, thoria, boria, etc., or combinations thereof, like silica-alumina, silica-zirconia, alumina-zirconia, etc. Any particular solid adsorbent material is selected with regard to its stability under conditions of its intended use. For example, in the treatment of a sour petroleum distillate the solid adsorbent carrier material should be insoluble in, and otherwise inert to, the aqueous caustic solutions and the petroleum distillate at treating conditions. The supported metal phthalocyanine catalyst preferably comprises from about 0.0001 to about 10 wt. % metal phthalocyanine.

The sour petroleum distillates herein contemplated vary widely in composition depending on the source of the petroleum from which the distillate was derived, the boiling range of the distillate, and possibly the method of processing the petroleum to produce the distillate. The differences include the character and concentration of the phenolic and other non-hydrocarbon impurities. The fixed bed treating system of this invention is particularly adapted to the treatment of those petroleum fractions boiling in excess of about 135° C., for example, kerosine, jet fuel, fuel oil, naphtha, and the like, and especially those petroleum fractions boiling in the range of from about 135° to about 300° C. These higher boiling sour petroleum distillates generally contain the more difficultly oxidizable mercaptans, that is, the caustic insoluble, highly hindered branched chain and aromatic thiols — especially the higher molecular weight tertiary and polyfunctional mercaptans. In the latter case, the difficulty arises from the presence of the phenolic toxins which occur in greater concentration in the higher boiling distillates. These impurities, while not necessarily adsorbable on the supported catalyst per se, are readily adsorbable in the higher oxidation state induced at the oxidative treating conditions. Although the present process is particularly applicable to the treatment of the heavier petroleum distillates, it is understood that the process may also be used for the treatment of the lower boiling sour petroleum distillates such as the natural, straight run and cracked gasolines.

The following examples are presented in illustration of one preferred embodiment of this invention and are not intended as an undue limitation on the generally broad scope of the invention as set out in the appended claims.

EXAMPLE I

About 100 ml of a sour kerosine fraction, described in Table I below, containing 930 wt. ppm mercaptan sulfur and 300 wt. ppm phenolics, was placed in a 500 ml Erlenmeyer flask together with 5 ml of a 10° Be[1] aqueous caustic solution and 13.5 cc of a charcoal-supported cobalt phthalocyanine monosulfonate catalyst containing 150 mg of said phthalocyanine per 100 cc of charcoal. The flask was stoppered and the contents mechanically shaken in air at ambient temperature conditions. Samples were extracted periodically and analyzed for mercaptan sulfur.

TABLE 1

| | |
|---|---|
| Total Sulfur, wt. % | 0.339 |
| Mercaptan Sulfur, wt. ppm | 930 |
| Hydrogen Sulfide Sulfur, wt. ppm | 1 |
| Copper, mg/liter | 0.055 |
| Acid No[1] mg KOH/g sample | 0.026 |
| Saybolt Color[2] | +14 |
| API Gravity at 60° F. | 0.8132 |
| Distillation | |
| IBP, ° F | 354 |
| 10 | 372 |
| 30 | 385 |
| 50 | 399 |
| 70 | 416 |
| 90 | 441 |
| 95 | 458 |

TABLE 1-continued

| | |
|---|---|
| EBP, ° F. | 486 |

[1]Acid No. is determined by titration with potassium hydroxide.
[2]Saybolt Color is measured as received.

EXAMPLE II

The sour kerosine fraction described in Table I, containing 930 wt. ppm mercaptan sulfur and 300 wt. ppm phenolics, was pretreated in accordance with one preferred embodiment of the present invention. Thus, the sour kerosine was percolated downwardly through a column containing a 100 cc bed of 10 × 30 mesh activated, lignite-derived, charcoal particles (Darco MRX). The kerosine was processed through the charcoal bed at about 1 UHSV at ambient temperature conditions to yield a kerosine product containing 756 wt. ppm mercaptan sulfur and 50 wt. ppm phenolics. This pretreated sour kerosine was then further treated as in Example I to convert the residual mercaptans to disulfides. The analytical data is summarized in Table II relative to the analytical data of Example I.

TABLE II

| | MERCAPTAN SULFUR, wt. ppm | |
|---|---|---|
| SHAKING TIME, MIN. | Example I | Example II |
| 0 | 930 | 756 |
| 60 | 30 | 9 |
| 120 | 21 | 6 |

The tabulated data evidences the improvement in catalyst activity resulting from the pretreatment of the sour kerosine fraction and separation of the phenolic catalyst toxins.

I claim as my invention:

1. A catalytic process for treating a sour petroleum distillate containing mercaptans, phenolic catalyst toxins and toxin precursors which comprises:

(a) treating said distillate in contact with an oxidizing agent and an adsorbent consisting essentially of charcoal at conditions to oxidize a portion of the mercaptan content of said distillate to disulfides, and to adsorb substantially all of the phenolic toxins and toxin precursors from said distillate;

(b) recovering said distillate from step (a) and contacting said distallate in an alkaline solution with an oxidizing agent and a supported metal phthalocyanine catalyst to oxidize the residual mercaptans contained therein to disulfides.

2. The process of claim 1 further characterized with respect to step (a) in that said charcoal is an activated lignite-derived charcoal.

3. The process of claim 1 further characterized with respect to step (a) in that said contact is effected at a temperature of from about 10° to about 250° C. and at a pressure of from about atmospheric to about 100 atmospheres.

4. The process of claim 1 further characterized with respect to step (a) in that said charcoal is pretreated with steam at a temperature of from about 400° to about 500° C. for a period of from about 1 to about 5 hours.

5. The process of claim 1 further characterized in that said sour petroleum distillate is a distillate boiling in the range of from about 135° to about 300° C.

6. The process of claim 1 further characterized with respect to step (b) in that said catalyst is an activated charcoal-supported metal phthalocyanine catalyst.

7. The process of claim 1 further characterized with respect to step (b) in that said metal phthalocyanine is a sulfonated derivative of a metal phthalocyanine.

8. The process of claim 1 further characterized with respect to step (b) in that said catalyst is an activated charcoal-supported cobalt phthalocyanine catalyst.

9. The process of claim 1 further characterized with respect to step (b) i that said catalyst is an activated charcoal-supported cobalt phthalocyanine monosulfonate.

10. The process of claim 1 further characterized with respect to step (b) in that said contact is effected at a temperature of from about 10° to about 250° C. and at a pressure of from about atmospheric to about 100 atmospheres.

* * * * *